US008123547B2

(12) United States Patent
Miller et al.

(10) Patent No.: US 8,123,547 B2
(45) Date of Patent: Feb. 28, 2012

(54) CONNECTOR ASSEMBLY

(75) Inventors: Scott Loren Miller, Chicago, IL (US); Randy Sanecki, Bensonville, IL (US); Matthew David Manley, Crystal Lake, IL (US); Joseph J. Heidenreich, Lake Zurich, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 12/969,802

(22) Filed: Dec. 16, 2010

(65) Prior Publication Data

US 2011/0151706 A1 Jun. 23, 2011

Related U.S. Application Data

(60) Provisional application No. 61/287,374, filed on Dec. 17, 2009.

(51) Int. Cl.
*H01R 4/38* (2006.01)

(52) U.S. Cl. ..... 439/382

(58) Field of Classification Search ..... 439/382, 439/374, 680, 500; 381/322, 330, 62.2, 68
See application file for complete search history.

(56) References Cited

U.S. PATENT DOCUMENTS

| | | | | |
|---|---|---|---|---|
| 5,064,268 | A * | 11/1991 | Morency et al. | 385/87 |
| 5,188,540 | A * | 2/1993 | Haertl et al. | 439/500 |
| 6,234,683 | B1 * | 5/2001 | Waldron et al. | 385/78 |
| 6,305,849 | B1 * | 10/2001 | Roehrs et al. | 385/59 |
| 6,357,929 | B1 * | 3/2002 | Roehrs et al. | 385/59 |
| 6,371,660 | B1 * | 4/2002 | Roehrs et al. | 385/59 |
| 6,685,361 | B1 * | 2/2004 | Rubino et al. | 385/58 |
| D523,812 | S * | 6/2006 | Brodin | D13/146 |
| 7,056,127 | B2 * | 6/2006 | Suzuki et al. | 439/39 |
| 7,585,116 | B2 * | 9/2009 | Cull et al. | 385/60 |
| 7,602,929 | B2 * | 10/2009 | Topholm et al. | 381/322 |
| 7,942,590 | B2 * | 5/2011 | Lu et al. | 385/78 |
| 2008/0236866 | A1 * | 10/2008 | Kim et al. | 174/113 R |
| 2008/0253717 | A1 | 10/2008 | Cull et al. | |

FOREIGN PATENT DOCUMENTS

EP 0779683 A1 6/1997

OTHER PUBLICATIONS

Related International Patent Application No. PCT/US2010/061071, Search Report dated Aug. 30, 2011; 3pgs.

* cited by examiner

*Primary Examiner* — Alexander Gilman
(74) *Attorney, Agent, or Firm* — Fitch, Even, Tabin & Flannery LLP

(57) ABSTRACT

A connector assembly includes a plug and a socket. The plug includes at least one conductive pin, at least one first electrical conductor coupled to the at least one conductive pin, and a base portion and a column portion. The column portion extends from the base portion and defines at least one slot along a length of the column portion. The column portion is constructed of a compliant material and includes at least one opening that extends through the base portion. The openings and slots are aligned such that the at least one conductive pin extends through the at least one opening and is received in the at least one slot. The socket has an inner surface and includes at least one second electrical conductor that extends through the socket, and holds the plug. When the plug is received by the socket, an interference fit is formed and maintained as between the second electrical conductor and the conductive pin. The base portion of the plug and the inner surface of the socket are engaged to create a seal.

15 Claims, 9 Drawing Sheets

CONNECTOR ASSEMBLY

CROSS REFERENCE TO RELATED APPLICATION

This patent claims benefit under 35 U.S.C. §119(e) to U.S. Provisional Application No. 61/287,374 entitled "Connector Assembly" filed Dec. 17, 2009 the content of which is incorporated herein by reference in its entirety.

TECHNICAL FIELD

This patent relates to a connector assembly for connecting, for example, a receiver placed within an ear to a hearing aid module.

BACKGROUND

Over the years, different connectors and connection arrangements have been used to connect various mechanical and electrical components together. One type of connecting arrangement creates an electrical connection thereby providing an electrical pathway between different electrical elements in a system.

Connectors are typically used in acoustic systems such as hearing aid systems. For example, connectors may be used to electrically and/or mechanically couple a receiver to processing circuitry. Unfortunately, previous connectors were often bulky and this presents a problem in acoustic systems where small parts are needed. For example, if the connector is too large, the system may be cumbersome or impossible to position in or around the ear of the human patient. Small connectors have been made, but these often suffer from their own problems. For example, these connectors may not provide adequate electrical connections. Another problem that occurs (especially in the context of connectors used in hearing aid systems) is that vibrations are transmitted from one system component (e.g., the receiver) to another component (e.g., the processing circuitry or its housing). The unwanted vibrations may damage circuitry or create sound quality problems for the wearer of the hearing aid.

BRIEF DESCRIPTION OF THE DRAWINGS

For a more complete understanding of the disclosure, reference should be made to the following detailed description and accompanying drawings wherein.

Figure 1:
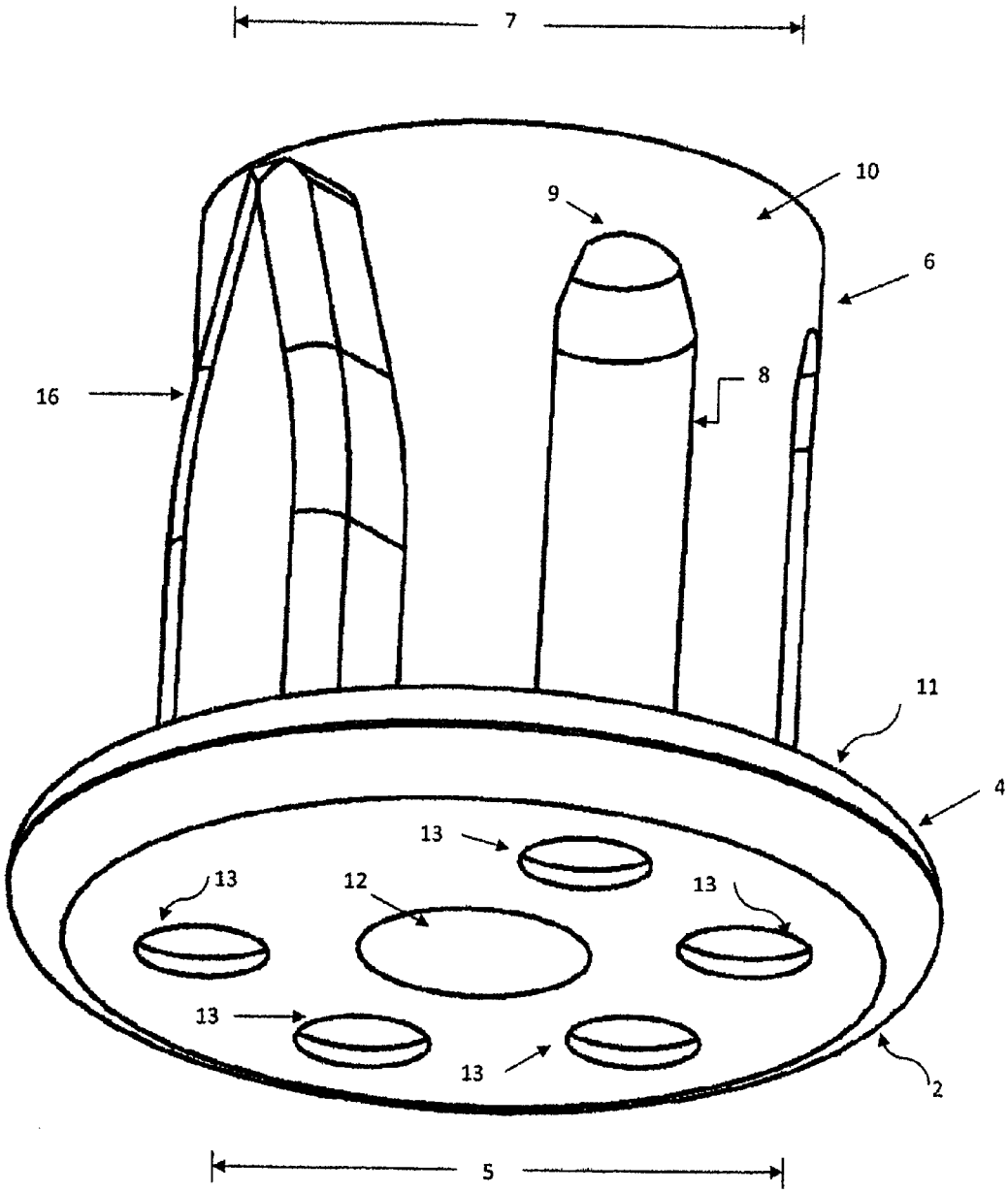
FIG. 1 illustrates a perspective view of a plug used as part of a connector assembly according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

A connector assembly is provided that is small in size so as to be usable in applications where space is at a premium such as in hearing aid applications. In some aspects, the approaches described herein provide an assembly with a seal that prevents unwanted environmental or other elements from entering the assembly. Vibration isolation is also provided so that vibrations that are received at the assembly are absorbed and are not transmitted to other system components. In so doing, sound quality for users is maintained and potential damage to assembly components (due to the vibrations) is avoided.

In many of these embodiments, a connector assembly includes a plug and a socket. The plug includes at least one conductive pin, at least one first electrical conductor coupled to the at least one conductive pin, a base portion, and a column portion. The column portion extends from the base portion and defines at least one slot along a length of the column portion. The column portion is constructed of a compliant material and includes at least one opening that extends through the base portion. The openings and slots are aligned such that the conductive pins extend through the openings and are received in the slots. The socket has an inner surface and includes at least one second electrical conductor that extends through the socket, and is configured to receive and hold the plug. When the plug is received by the socket, an interference fit is created and maintained as between the at least one second electrical conductor of the socket and the at least one conductive pin of the plug so as to establish an electrical connection therebetween. The base portion of the plug and the inner surface of the socket are engaged to create a seal.

In some aspects, the first electrical conductors are configured to receive signals from an electrical element such as a speaker and a receiver. Other examples of electrical elements are possible. In other aspects, the second electrical conductors are coupled to an audio processing module.

In still other aspects, the inner surface of the socket includes a plurality of shelves and each of the plurality of shelves has a top surface. The top surface of each of the shelves is at a different height with respect to an end of the socket relative to the others. In another example, the top surfaces of adjacent shelves (or at least some other shelves) are at different heights. Electrical shorts between pins can advantageously be prevented from occurring using this approach.

Various materials may be used to construct the plug and/or its column portion. For example, rubber and plastic materials may be used. In still other examples, TPU, TPE, or silicone can be used. Other examples of materials are possible.

In some aspects, the column portion of the plug is constructed of materials that are effective to dampen, reduce, or eliminate vibrations received via the at least one pin. Thus, vibrations received at the plug are not transmitted onward to other system components.

In other aspects, the at least one slot comprises a plurality of slots and further comprises a key. The key is disposed in one of the plurality of slots so as to prevent lateral and rotational movement of the plug when the plug is inserted into the socket. In other aspects, the key ensures that the plug can be inserted in only a proper orientation. In these examples, if the user pushes the part in the wrong orientation, the key will advantageously stop the part from entering the socket.

The second electrical conductor can be configured or dimensioned in a number of different ways. For example, the second conductor may be an L-shaped rigid wire. In other examples, the second conductor is an electrical contact that is formed with the socket. Other examples of conductors are possible.

In others of these embodiments, a connector assembly for use in a hearing aid system includes a plug and a socket. The plug includes at least one conductive pin, a base portion, and a column portion. The conductive pin is configured to be attached at least one first conductor and the at least first conductor is coupled to an audio component. The column portion extends from the base portion and defines at least one slot positioned along a length of the column portion. The column portion is constructed of a compliant material and the base portion includes at least one opening that extends through the base portion. The openings and the slots are aligned such that the conductive pins extend through the openings and are received in the slots.

The socket has an inner surface and includes at least one second electrical conductor that extends through the socket and is coupled to an audio processing module. The socket is configured to receive and hold the plug.

When the plug is received by the socket, an interference fit is formed and maintained as between the at least one second electrical conductor of the socket and the at least one conductive pin of the plug so as to establish an electrical connection therebetween. The base portion of the plug and the inner surface of the socket are in engagement to create a seal. The seal is effective to keep all or substantially all foreign or environmental elements from entering the interior of the socket assembly. The column portion of the plug and/or the base portion of the plug dampen vibrations received via the at least one pin. In this respect, the column portion of the plug is constructed of a material such as a rubber and a plastic that is effective to dampen vibrations. Advantageously, this material is also compliant and helps create an electrical connection between the pins and the second conductors.

Various audio components can also be used. For example, the audio component may be a receiver and a speaker. Other examples are possible.

It will be appreciated that many of the examples described herein relate to hearing aids and other acoustic/sound processing systems. However, it will be appreciated that the approaches described herein are not limited to these types of systems and may be used in many and varied applications that do not involve sound processing.

FIG. 1 illustrates a plug 2 which may be used as part of a connector assembly for, for example, a hearing aid system. The plug 2 may be constructed from rubber, plastic, or other compliant material. As used herein, a "compliant material" refers to a material that characteristically deforms under an applied force but also tends to spring back or return to its original configuration or shape once the force is removed. The plug 2 may have a base 4 having an overall diameter 5 greater than a diameter 7 of a column 6 which extends from the base 4. The column 6 may be, in an embodiment, somewhat cylindrical in shape. Other examples of shapes are possible. Grooves or slots 8 may be formed along a surface 10 of the column 6. The grooves 8 may be cylindrical in shape, although other shapes are contemplated. The grooves 8 may have a tapered end 9.

The base 4 may have holes 13 which surround compliance hole 72 for receiving a pin 14. The holes 13 are sized to receive pins 14 which will be described in more detail below. Although five holes 13 are illustrated, any number of holes 13 may be provided as well as any number of pins 14 which correspond to the holes 13. The holes 13 are aligned with the grooves 8. Once the pins 14 are inserted through the holes 13, they are positioned within the grooves 8. The plug 2 may be integrally formed via, for example, injection molding, or other method contemplated by those of skill in the art. In another embodiment, the column 6 and the base 4 may be separate pieces which are attached to each other via adhesive, fastener or other methods contemplated by those of skill in the art. A ridge or key 16 may be formed along a length of the column 6. The key 16 may ensure proper positioning of the plug 2 when placed within a socket 50 (described in further detail below), and may prevent, for example, lateral and/or rotational movement of the plug 2 when placed within the socket 50. In one example, the base 4 has an outer diameter of approximately 2.4 mm and a length of approximately 0.3 mm; and the column 6 has a diameter of approximately 1.6 mm and a length of approximately 1.7 mm (the entire part in one example is approximately 2.0 mm long). In one example, the grooves 8 are approximately 1.75 mm long and approximately 0.42 mm in diameter.

Figure 2:
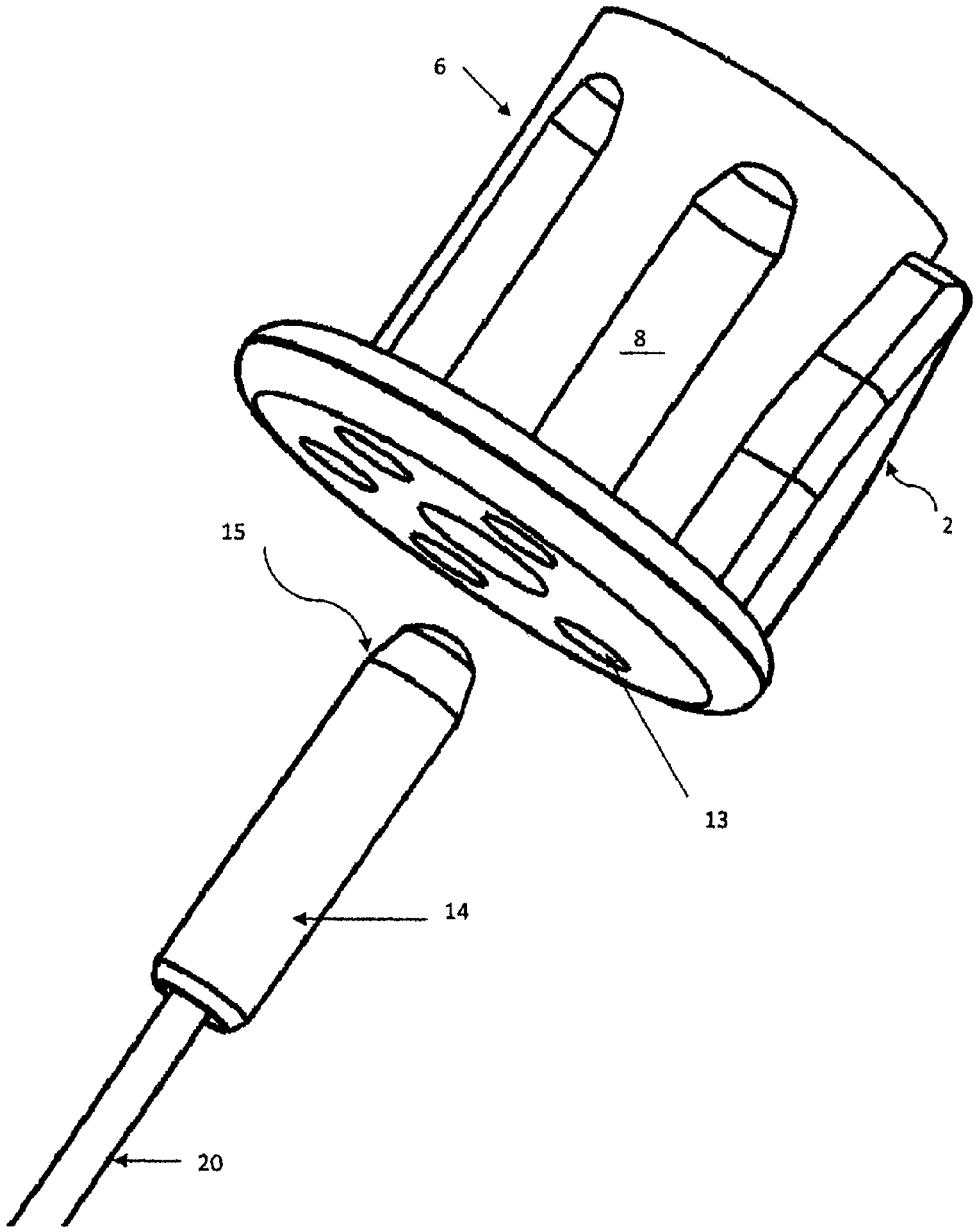
FIG. 2 illustrates a perspective view of the plug of FIG. 1 prior to insertion of a pin according to various embodiments of the present invention.
Figure 3:
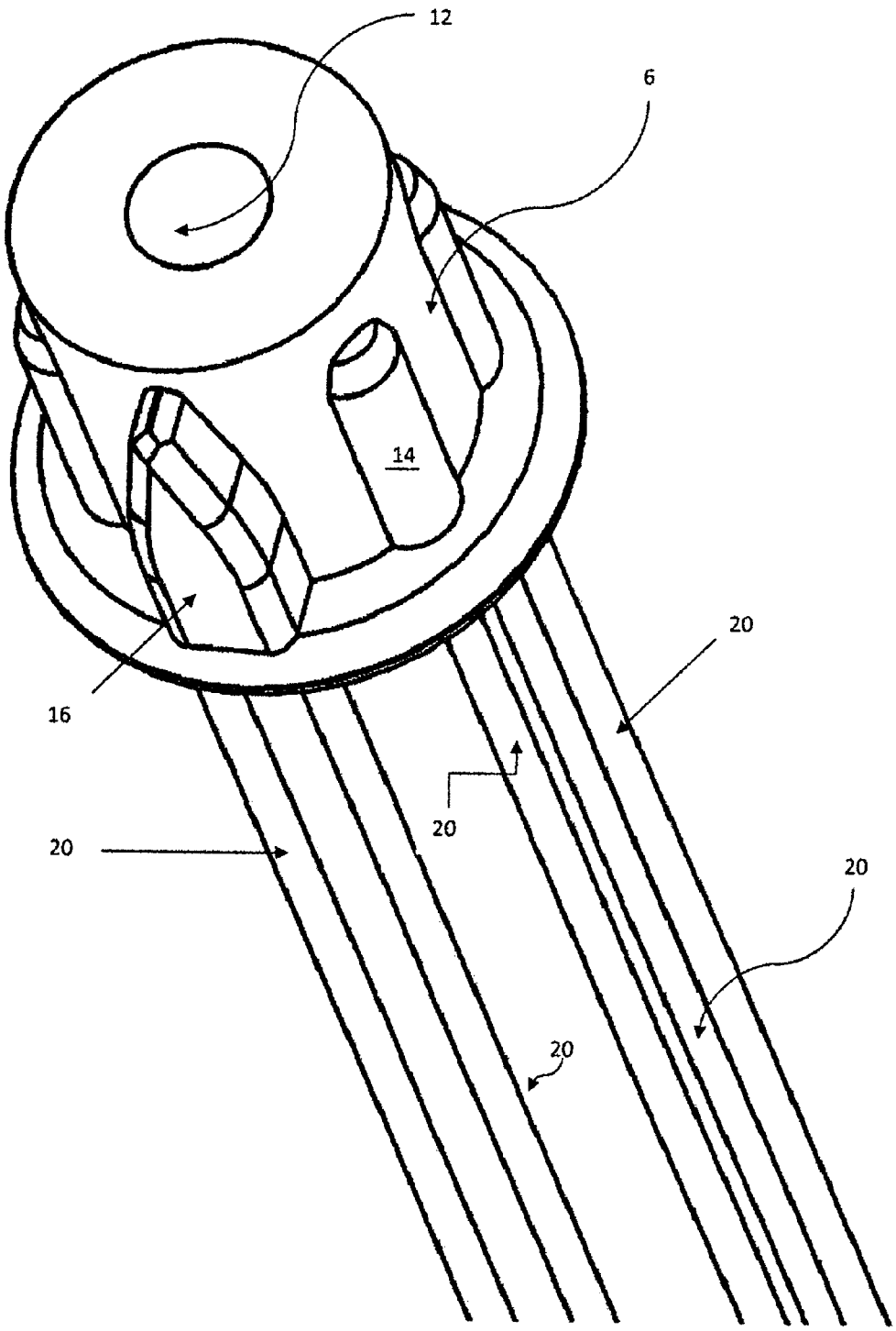
FIG. 3 illustrates a perspective view of the plug of FIG. 1 after insertion of a plurality of pins according to various embodiments of the present invention.
Figure 7:
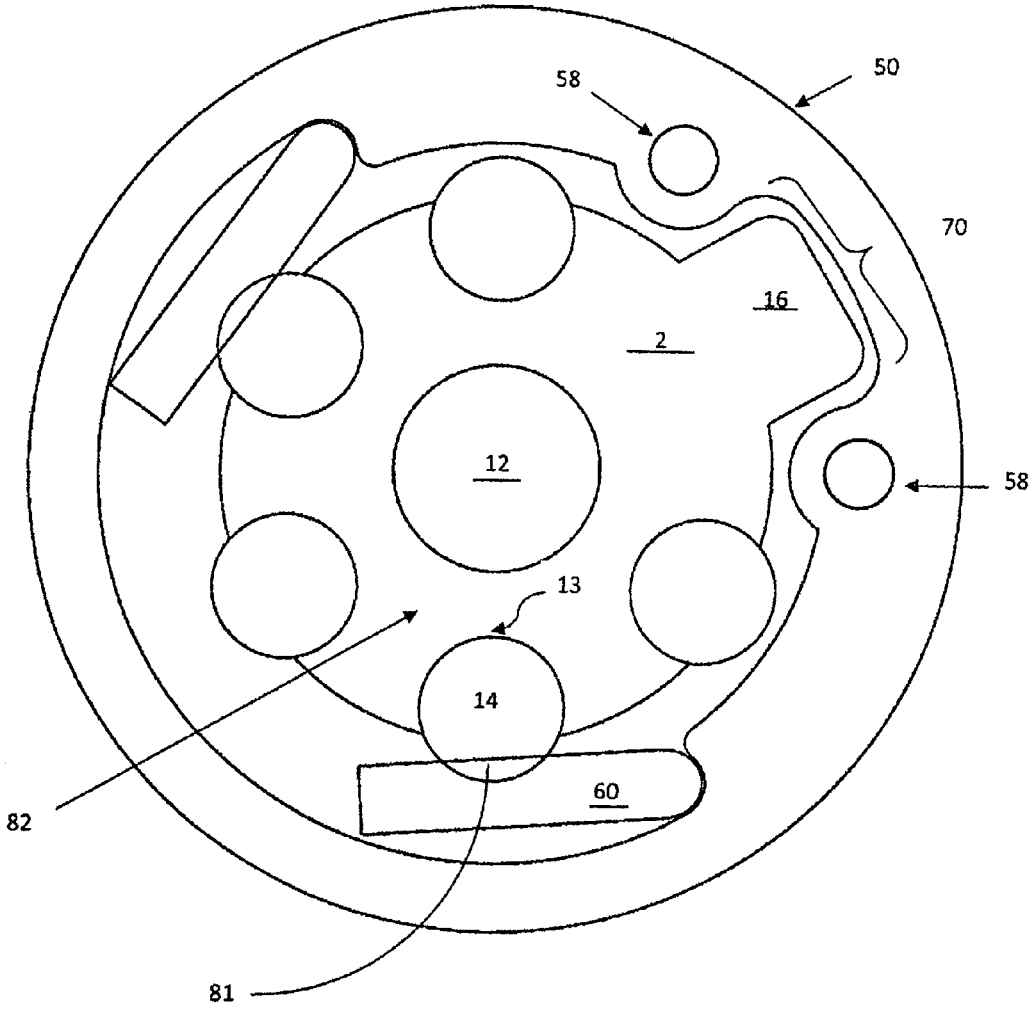
FIG. 7 illustrates a cross-sectional view of a plug and socket fitted to form a connector assembly according to various embodiments of the present invention.
Figure 8:
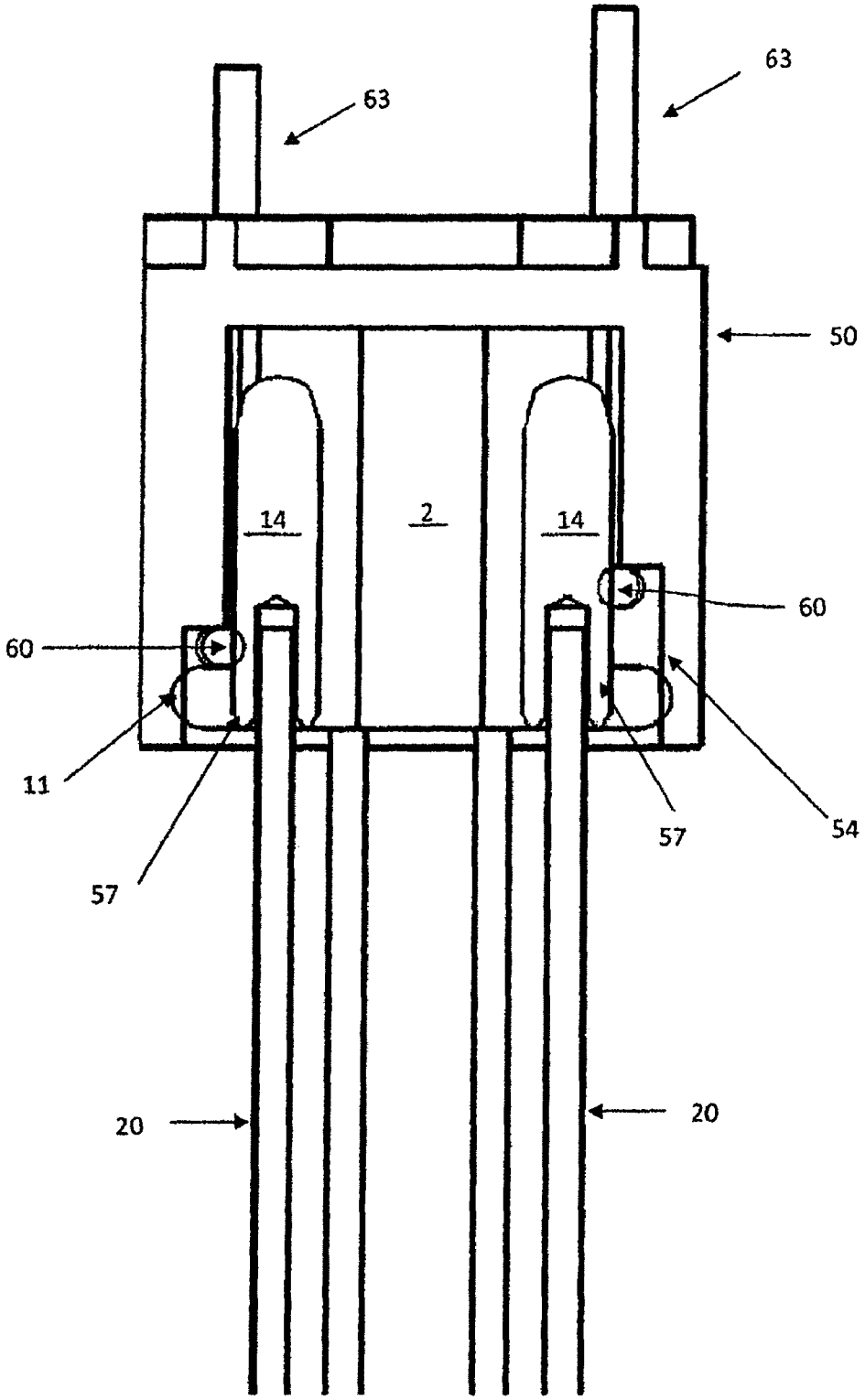
FIG. 8 illustrates a side cross-sectional view of the connector assembly of FIG. 7 according to various embodiments of the present invention.

FIG. 2 illustrates the plug 2 where the pin 14 is inserted through one of the holes 13. Attached to the pin 14 is a conductive wire 20. As previously stated, once the pin 14 is inserted through the hole 13, it is positioned within the groove or slot 8, as illustrated in FIG. 3. The pin 14 may have a tapered end 15 which is shaped to coincide with a shape of the tapered end 9 of the groove 8. The pin 14 may be secured within the hole 13 in the base 4 by interference fit, adhesive, or other fastening method, such as a locking arrangement or locking mechanism. Likewise, the pin 14 may be secured within the groove 8 by interference fit, adhesive, or other fastening method contemplated by those of skill in the art. In an aspect, tube anchors (not pictured) may be implemented. In FIG. 7, the pin 14 is illustrated as being secured within the plug 2. The pins 14 slide through the hole 13 up through the groove 8 until they otherwise become secured within the groove 8. FIG. 8 illustrates an example which shows that once the pins 14 are positioned completely within the groove 8, the plug material snaps behind the pin 14 due to a tapered end 57 at the bottom of the plug 2 (i.e., a tapered width of the hole 13). Other means of securing the pin 14 after insertion into the plug 2 are contemplated and may be used.

Figure 4:
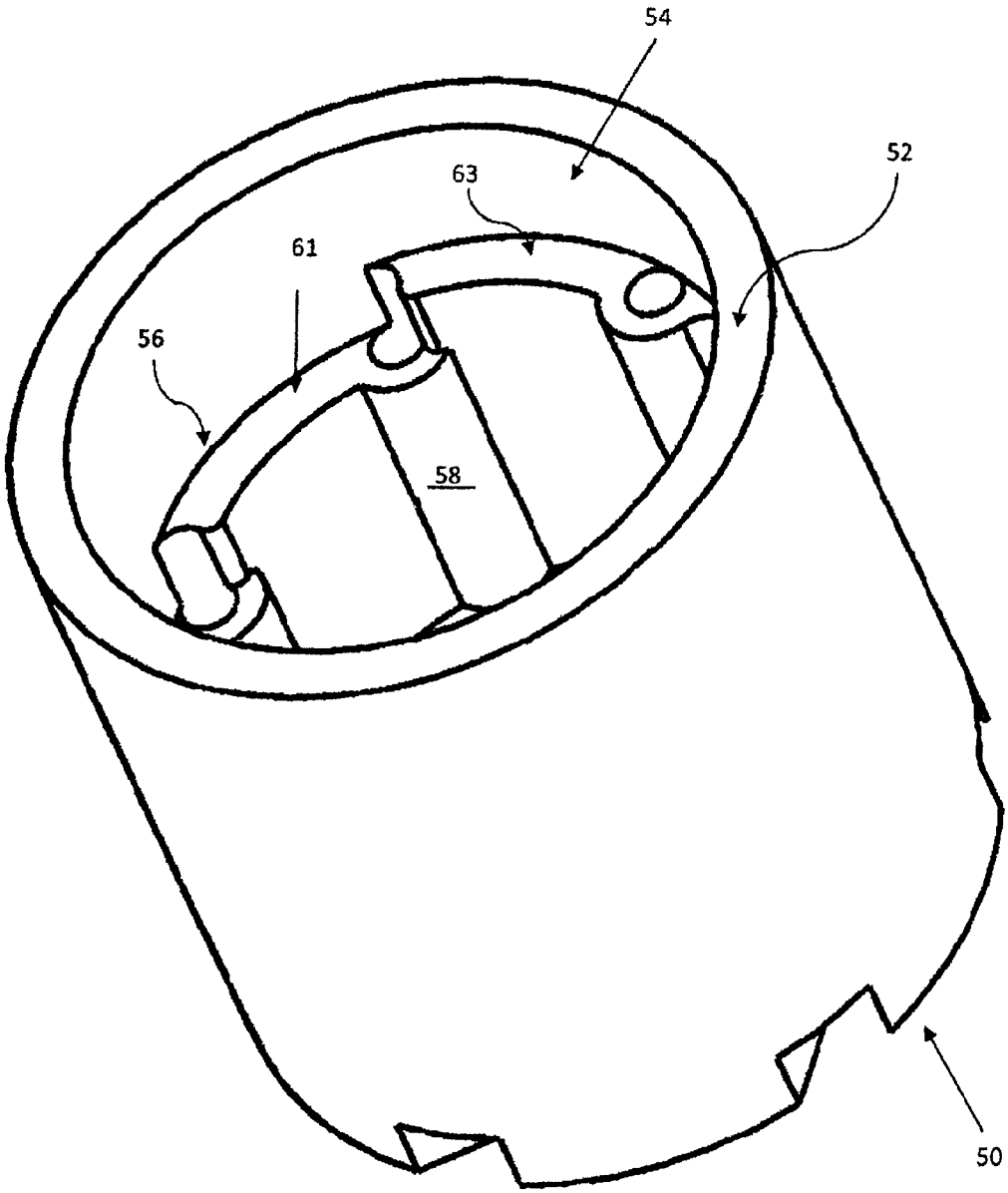
FIG. 4 illustrates a perspective view of a socket for receiving a plug as part of a connector assembly according to various embodiments of the present invention.
Figure 5:
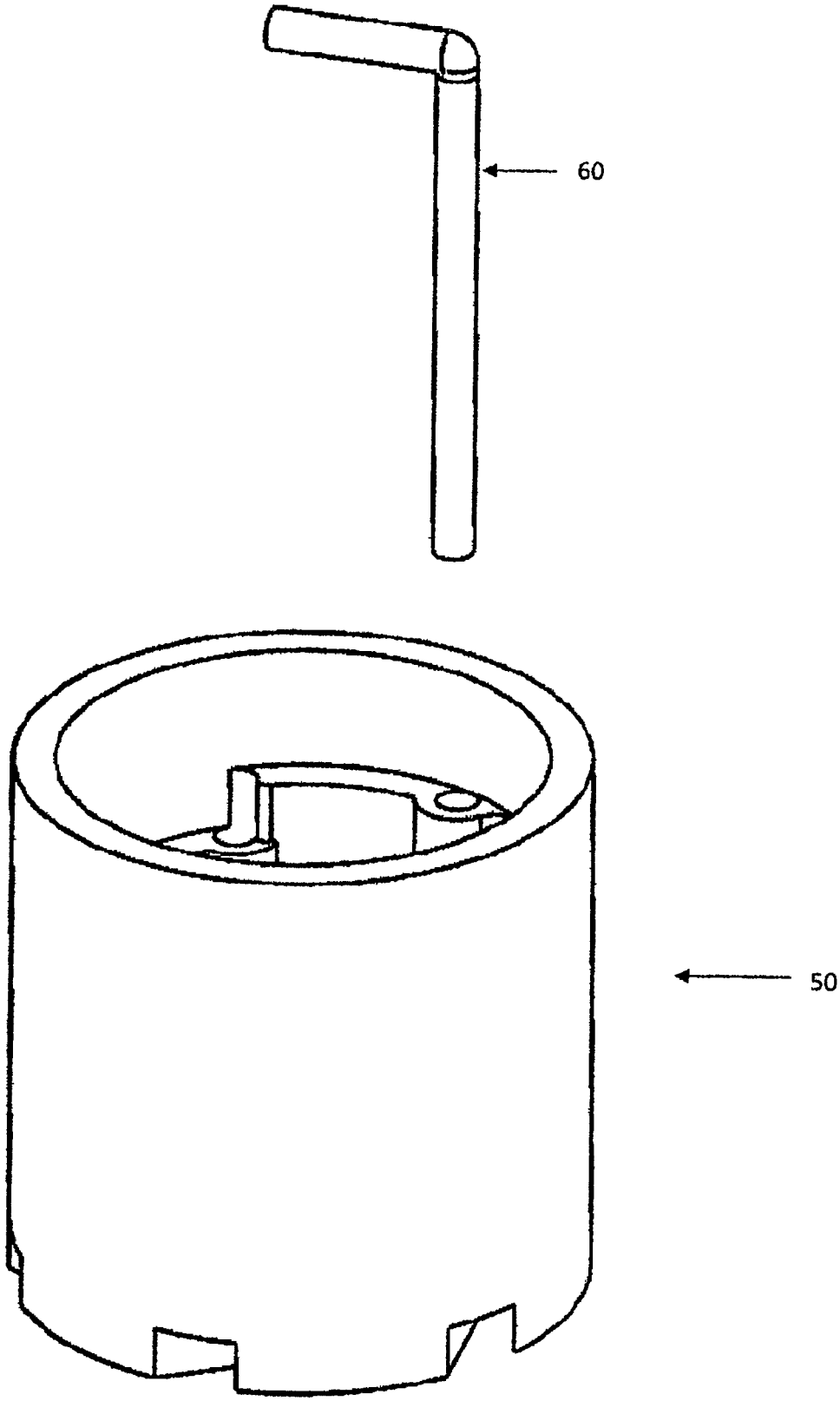
FIG. 5 illustrates a perspective view of the socket of FIG. 4 prior to insertion of a rigid wire according to various embodiments of the present invention.
Figure 6:
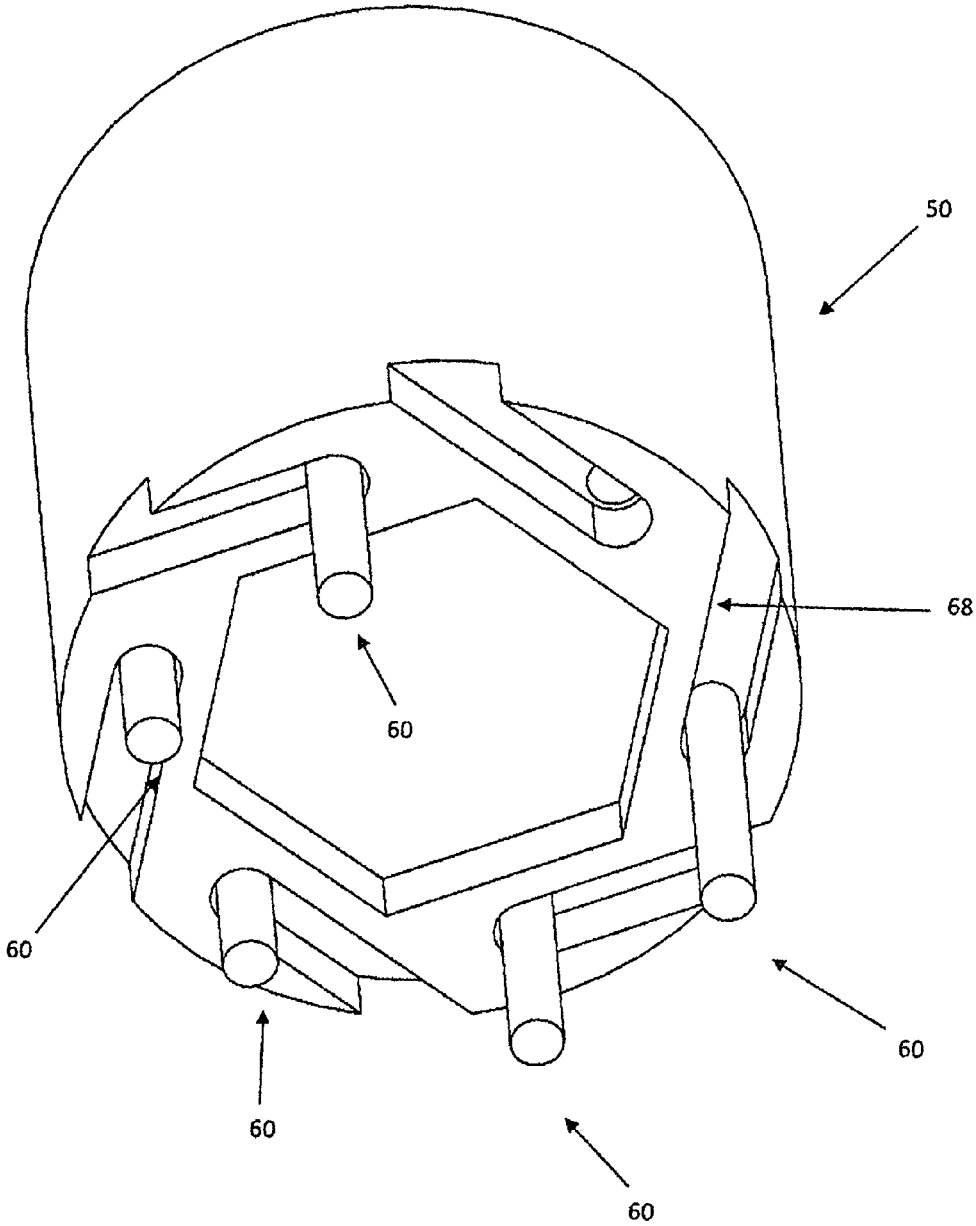
FIG. 6 illustrates a bottom perspective view of the socket of FIG. 4, with rigid wires inserted, according to various embodiments of the present invention.

FIG. 4 illustrates a socket 50 into which the plug 2 may be fitted. The socket 50 has a casing or shell 52 which may be cylindrical in shape, although other shapes are contemplated. The casing 52 may define an interior surface 54 having shelves 56 formed thereupon. In another embodiment, the shelves 56 are separate components which are attached to the interior surface 54. Formed within the shelves 56 are sleeves 58 shaped to receive and support rigid wires 60 (these wires might be, for example, traditional cylindrical wires, but also may be stamped metal contact arms with, for example, a rectangular cross section). The shelves 56 may have top surfaces 61, 63 which are positioned at varying heights to prevent a short circuit of an electrical circuit when the plug 2 is secured within the socket 50. More specifically, because the plug 2 may include one or more pins 14 and wires 20, the potential exists for those pins 14 to contact one or more rigid wires 60, thereby causing a short circuit. The variance of height for each of the adjacent shelves 56 prevents this from occurring. FIG. 6 illustrates the rigid wires 60 extending from the bottom 68 of the socket 50. In one example, the socket has a diameter of approximately 2.7 mm and is approximately 2.65 mm long.

FIG. 7 illustrates the socket 50 and plug 2 in an assembled state (i.e., the plug 2 is inserted within the socket 50). The key 16 is positioned within a groove 70 shaped to receive the key 16 and prevent lateral and/or rotational movement of the plug 2 within the socket 50. Rigid wire 60 can be seen extending tangentially from the inner surface 54 and through the sleeve 58. The rigid wire 60 contacts the pin 14 to create an electrical connection. The electrical connection may be maintained via an interference fit between the plug 2 and the socket 50. As used herein, "interference fit" refers to fits between two parts that are maintained by frictional forces as opposed to by some other fastening arrangement (e.g., an adhesive or a fastener). In the present example, the rigid wire 60 and the pin 14 are arranged and/or dimensioned to occupy the same physical space, for example, the region 81 of FIG. 7. The inner diameter of the socket 50 and/or the size, shape and positioning of the wire 60 can be arranged and their dimensions selected to accomplish this result. Since these two parts cannot physically occupy the same space, the column portion 6 of the plug 2 deforms inward in the direction indicated by the arrow labeled 82 thereby moving the pin 14 (disposed in one of the slots or grooves of the plug 2) radially inward. The resultant frictional force created between the wire 60 and the pin 14 holds and maintains the wire 60 and the pin 14 together so as to create an electrical connection. The frictional force that is created is adequate to maintain these two elements in this position.

A compliance hole 72 may extend through the plug 2 to enable the plug 2 to bend or otherwise become compliant to the shape of the socket 50. FIG. 8 shows a side cross-sectional view of the plug 2 and socket 50 interconnected. Again, the electrical connection between the pins 14 and the rigid wires 60 is shown.

Figure 9:
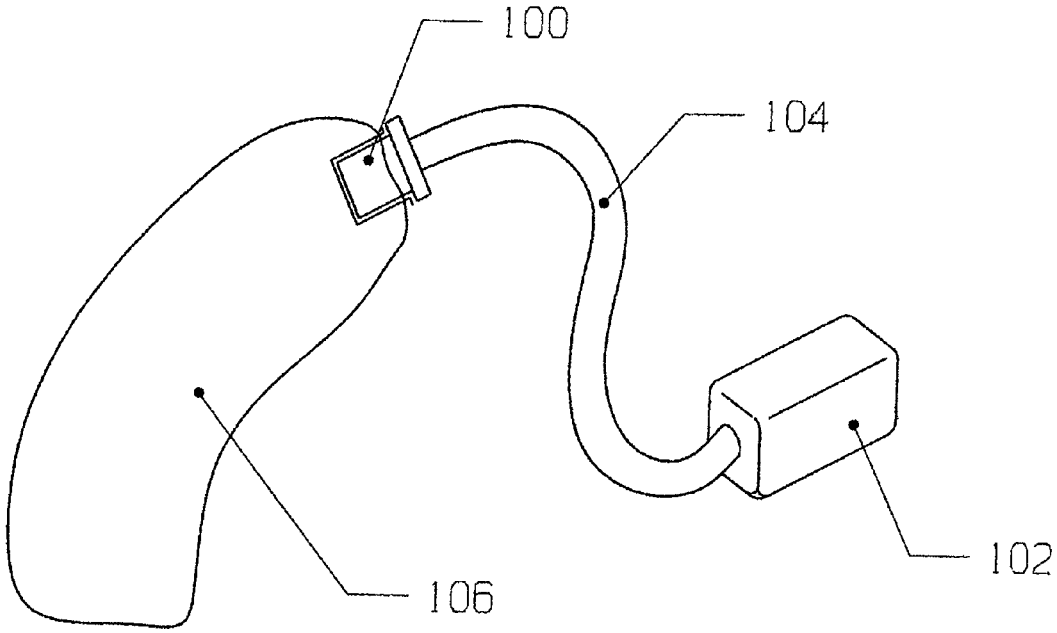
FIG. 9 is a diagram of a one example use for a connector assembly in a hearing aid system according to various embodiments of the present invention.

FIG. 9 illustrates an application for the connector 100. A receiver 102 may be inserted within, or partially within an ear or ear canal. Wiring 104 may extend from the receiver to the connector 100. The electrical connection provided by the connector 100 may allow for transfer of signals to a processing module 106 of a hearing aid system, such as a Behind-The-Ear module or other module. The connector 100 may allow the system to be disassembled and reassembled in a convenient manner, whereby the connector 100 is removed from the module 106 to allow for maintenance of any of the items. Opposite ends 63 of the rigid wires 60 contact wiring within the module 106. Wires 60 can connect to circuitry in the module 106 in many ways. In an embodiment, the wires 60 can be folded down onto the housing 50 and soldered to a printed circuit board or flex circuit. In another embodiment, the wires 60 could be soldered to other wires in the module 106.

Also, it should be noted that the base 4 of the plug 2 may be secured within the socket 50 at an interface with the socket surface 54 to create a seal for this connector 100, as shown in FIG. 8. More specifically, an outer surface of the base 11 may contact the inner surface 54. The base 4 may be secured via any of the methods described above, including interference fit, adhesion, or other contemplated method. Creating a seal to protect electrical connections from, for example, moisture and/or foreign materials is a common requirement for hearing instrument designs.

The construction of the plug 2 or portions of the plug 2 of a compliant material also serves to dampen vibrations that may be received at the plug and prevent these vibrations from being transmitted onward to other system components. Referring to FIGS. 8 and 9, vibrations created at the receiver 102 are transmitted along wires 20 and through pins 14 to the plug 2. The compliant material of the plug 2 dissipates and/or dampens these vibrations (or substantially all these vibrations) so that these vibrations are not transmitted to the socket 50 and then to the module 106. The column portion and/or the base material may be constructed from this material and this material can be a compliant rubber or plastic to mention two examples.

It will be appreciated that the number of wires 20 and slots/grooves used in the plugs described herein can be varied and that any number is possible. It will be further understood that in some aspects the number of slots can be greater than the number of wires/pins used. In other words, all the slots may not be occupied with pins/wires. In this way, a plug can be customized by a user to use an exact number of wires that a particular user/application requires.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A connector assembly comprising:

a plug, the plug including:

at least one conductive pin;

at least one first electrical conductor coupled to the at least one conductive pin;

a base portion and a column portion, the column portion extending from the base portion, the column portion defining at least one slot along a length of the column portion, the column portion being constructed of a compliant material, the base portion including at least one opening that extends through the base portion, the at least one opening aligned with the at least one slot such that the at least one conductive pin extends through the at least one opening and is received in the at least one slot;

a socket, the socket with an inner surface and including at least one second electrical conductor that extends through the socket, and the socket being configured to receive and hold the plug;

wherein when the plug is received by the socket, an interference fit is formed and maintained as between the at least one second electrical conductor of the socket and the at least one conductive pin of the plug so as to establish an electrical connection therebetween; and such that the base portion of the plug and the inner surface of the socket are engaged together to create a seal.

2. The connector assembly of claim 1 wherein the at least one first electrical conductor is configured to receive signals from an element selected from the group consisting of a speaker and a receiver.

3. The connector assembly of claim 1 wherein the at least one second electrical conductor is coupled to an audio processing module.

4. The connector assembly of claim 1 wherein the inner surface of the socket includes a plurality of shelves and each of the plurality of shelves has a top surface, the top surface of each of the shelves being at a different height with respect to an end of the socket relative to the others.

5. The connector assembly of claim 1 wherein the column portion of the plug is constructed of a material selected from the group consisting of a rubber and a plastic.

6. The connector assembly of claim 1 wherein the column portion of the plug is effective to dampen vibrations received via the at least one pin.

7. The connector assembly of claim 1 wherein the at least one slot comprises a plurality of slots and further comprises a key, the key being disposed in one of the plurality of slots so as to prevent lateral and rotational movement of the plug when inserted into the socket.

8. The connector assembly of claim 1 wherein the at least one second electrical conductor is a conductor selected from the group consisting of: an L-shaped rigid wire and an electrical contact formed with the socket.

9. A connector assembly for use in a hearing aid system, the assembly comprising:

a plug, the plug including:

at least one conductive pin, the conductive pin configured to be attached at least one first conductor, the at least first conductor being coupled to an audio component;

a base portion and a column portion, the column portion extending from the base portion, the column portion defining at least one slot along a length of the column portion, the column portion being constructed of a compliant material, the base portion including at least one opening that extends through the base portion, the at least one opening and the at least one slot being aligned such that the at least one conductive pin extends through the at least one opening and is received in the at least one slot;

a socket, the socket with an inner surface and including at least one second electrical conductor that extends through the socket and is coupled to an audio processing module, and the socket being configured to receive and hold the plug;

wherein when the plug is received by the socket, an interference fit is formed and maintained as between the at least one second electrical conductor of the socket and the at least one conductive pin of the plug so as to establish an electrical connection therebetween;

such that the base portion of the plug and the inner surface of the socket are engaged together to create a seal; and wherein the column portion of the plug is effective to dampen vibrations received via the at least one pin.

10. The connector assembly of claim 9 wherein the inner surface of the socket includes a plurality of shelves and each of the plurality of shelves has a top surface, the top surface of each of the shelves being at a different height with respect to an end of the socket relative to the others.

11. The connector assembly of claim 9 wherein the column portion of the plug is constructed of a material selected from the group consisting of a rubber and a plastic.

12. The connector assembly of claim 9 wherein the at least one slot comprises a plurality of slots and further comprises a key, the key being disposed in one of the plurality of slots so as to prevent lateral and rotational movement of the plug when inserted into the socket.

13. The connector assembly of claim 9 wherein the at least one second electrical conductor is a conductor selected from the group consisting of: an L-shaped rigid wire and an electrical contact formed with the socket.

14. The connector assembly of claim 9 wherein the audio component is selected from the group consisting of a receiver and a speaker.

15. The connector assembly of claim 9 wherein the audio processing module is a Behind the Ear (BTE) module.

* * * * *

UNITED STATES PATENT AND TRADEMARK OFFICE

CERTIFICATE OF CORRECTION

PATENT NO. : 8,123,547 B2
APPLICATION NO. : 12/969802
DATED : February 28, 2012
INVENTOR(S) : Scott Loren Miller et al.

It is certified that error appears in the above-identified patent and that said Letters Patent is hereby corrected as shown below:

ON THE COVER PAGE:
Item (75), line 2, delete “Bensonville,” and insert --Bensenville,-- therefor.

Signed and Sealed this
Fifth Day of June, 2012

David J. Kappos

David J. Kappos
*Director of the United States Patent and Trademark Office*